US009076313B2

(12) United States Patent
Piccolo, III et al.

(10) Patent No.: US 9,076,313 B2
(45) Date of Patent: Jul. 7, 2015

(54) METHOD FOR SELF-TESTING NOTIFICATION APPLIANCES IN ALARM SYSTEMS

(71) Applicant: SimplexGrinnell LP, Westminster, MA (US)

(72) Inventors: Joseph Piccolo, III, Fitzwilliam, NH (US); David Dahlstrom, Hubbardston, MA (US)

(73) Assignee: TYCO FIRE & SECURITY GMBH, Neuhausen Am Rheinfall (CH)

( * ) Notice: Subject to any disclaimer, the term of this patent is extended or adjusted under 35 U.S.C. 154(b) by 86 days.

(21) Appl. No.: 13/836,831

(22) Filed: Mar. 15, 2013

(65) Prior Publication Data

US 2014/0266676 A1 Sep. 18, 2014

(51) Int. Cl.
*G08B 29/00* (2006.01)
*G08B 29/12* (2006.01)

(52) U.S. Cl.
CPC ..... *G08B 29/00* (2013.01); *G08B 29/126* (2013.01)

(58) Field of Classification Search
CPC ..... G08B 29/129
USPC ..... 340/514, 506, 516, 635, 641, 384.1, 340/384.4, 287
See application file for complete search history.

(56) References Cited

U.S. PATENT DOCUMENTS

| | | | | |
|---|---|---|---|---|
| 7,629,880 | B2 * | 12/2009 | Stilp et al. | 340/508 |
| 8,228,182 | B2 * | 7/2012 | Orsini et al. | 340/514 |
| 2012/0286946 | A1 | 11/2012 | Karl et al. | |

FOREIGN PATENT DOCUMENTS

| | | | |
|---|---|---|---|
| DE | 29611600 | U1 | 9/1996 |
| GB | 2307082 | A | 5/1997 |
| WO | 98/08205 | A1 | 2/1998 |

OTHER PUBLICATIONS

International Search Report and Written Opinion mailed Jun. 23, 2014 for PCT Application PCT/US2014/05829 filed Mar. 13, 2014.

* cited by examiner

*Primary Examiner* — Toan N Pham
(74) *Attorney, Agent, or Firm* — Kacvinsky Daisak Bluni PLLC

(57) ABSTRACT

A method for self-testing notification appliances in an alarm system by determining whether the performance of the notification appliances has degraded over time. The method may include the steps of measuring and recording initial output levels of notification features of the notification appliances at a first time, measuring test output levels of the notification features at a second time after the first time, and comparing the test output levels to respective threshold output levels that are derived from the initial output levels. The method may further include recording a pass result for notification appliances whose notification features produced test output levels that exceeded the respective threshold output levels, and recording a fail result for notification appliances whose notification features produced test output levels that did not exceed the respective threshold output levels.

19 Claims, 5 Drawing Sheets

METHOD FOR SELF-TESTING NOTIFICATION APPLIANCES IN ALARM SYSTEMS

FIELD OF THE DISCLOSURE

The disclosure relates generally to the field of alarm systems, and more particularly to an improved method for self-testing notification appliances in alarm systems.

BACKGROUND OF THE DISCLOSURE

Alarm systems, such as fire alarm systems, typically include a plurality of notification appliances (e.g. horn/strobe units), that are installed throughout a monitored building and that are configured to be activated upon the detection of an alarm condition, such as the presence of fire or smoke. Occupants of the building may thereby be notified of a potentially hazardous condition and may evacuate the building or take other action before being harmed. It is therefore critically important that notification appliances of alarm systems always be in good working order.

Governmental entities may require that notification appliances, and particularly those of fire alarm systems, be tested periodically to verify that such appliances are operating properly. Such testing is typically performed by one or more designated inspectors who walk through an entire monitored building and physically visit each notification appliance installed therein. The inspectors may activate each appliance for a predefined amount of time to verify functionality, and may make note of whether each appliance performed in a satisfactory manner. Particularly, an inspector may record a "pass" result for notification appliances that successfully activated their notification features (e.g. strobes, horns, etc.) and may record a "fail" result for notification appliances that failed to activate their notification features. Evaluating the functionality of notification appliances in this manner can be extremely burdensome, as it can be time-consuming and arduous to physically visit every notification appliance in a building. This is especially true for alarm systems that include a large number of notification appliances and/or that include notification appliances that are installed in parts of a building that are not readily accessible.

In order to alleviate the burden of notification appliance testing, so-called "self-test" technologies have been developed which enable notification appliances to automatically evaluate their own functionality. For example, a notification appliance that is equipped with self-test capability may include one or more sensors, such as a microphone, sound detector, camera, photo eye, light detector, etc., located adjacent the appliance's notification features (e.g. strobes, horns, sirens, etc.). Upon executing a self-test of such a notification appliance, such as may be initiated from a centrally located alarm panel or workstation within a monitored building, the notification appliance may activate its notification features for a predefined amount of time. While the notification features of the appliance are active, the sensors may measure the output generated thereby. If it is determined from the measurement that the notification features successfully generated output, a "pass" result may be automatically recorded by the appliance. Conversely, if it is determined that the notification features failed to generate output, a "fail" result may be automatically recorded by the appliance. The self-test feature thereby relieves inspectors from having to physically visit, manually test, and observe each appliance in an alarm system to effectuate a functional test.

One shortcoming associated with existing self-test technologies is that they are only capable of providing a binary indication of a notification appliance's operability. That is, they are only capable of determining whether a notification appliance was able to produce output or not. This basic detection capability is generally sufficient to satisfy rudimentary testing requirements. However, in some cases, more stringent testing requirements may be imposed that require determining whether, and to what degree, the performance of a notification appliance has degraded over time, not merely whether an appliance is capable of producing output.

SUMMARY

In view of the foregoing, it would be advantageous to provide improved means for self-testing notification appliances in an alarm system wherein such means provide an indication of whether, and to what degree, the performance of such notification appliances has degraded over time.

An exemplary method in accordance with the present disclosure may include the steps of measuring and recording initial output levels of notification features of notification appliances in an alarm system at a first time, measuring test output levels of the notification features at a second time after the first time, and comparing the test output levels to respective threshold output levels that are derived from the initial output levels. The method may further include recording a pass result for notification appliances whose notification features produced test output levels that exceeded the respective threshold output levels, and recording a fail result for notification appliances whose notification features produced test output levels that did not exceed the respective threshold output levels.

DETAILED DESCRIPTION

Figure 1:
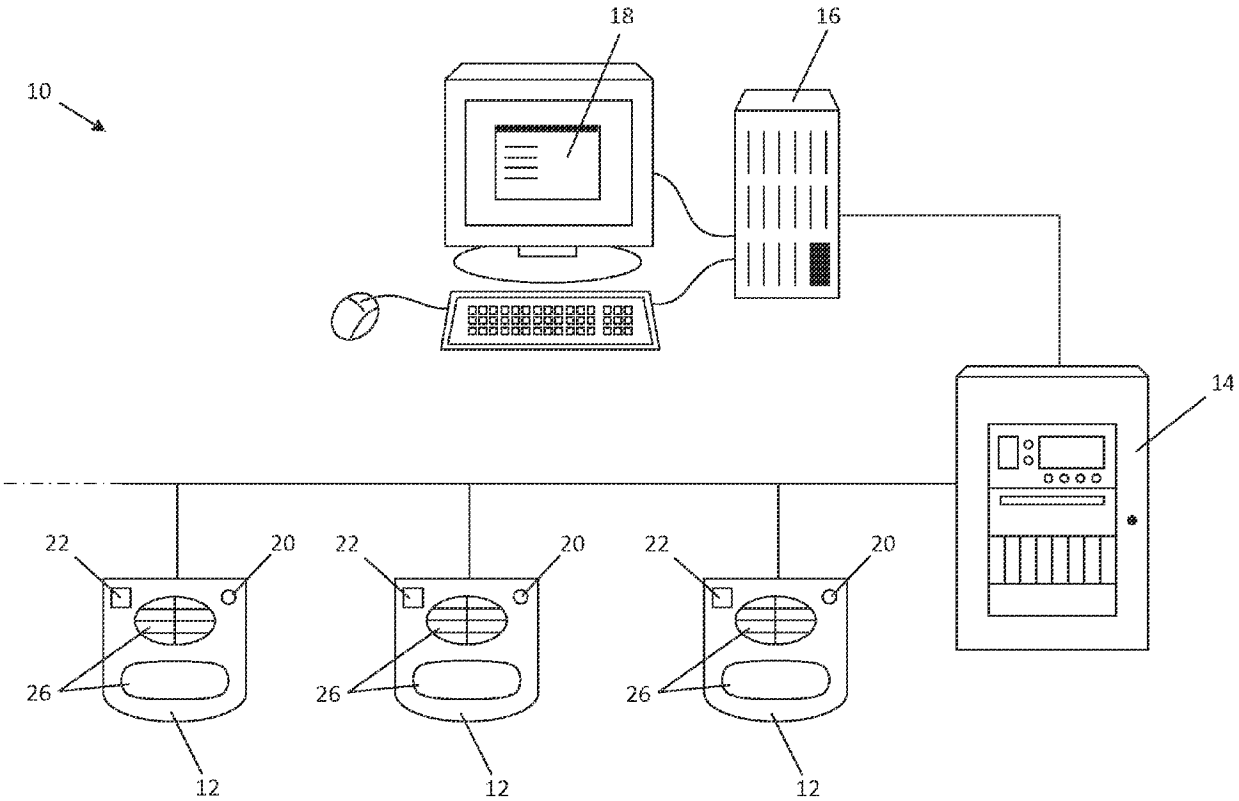
FIG. 1 is a schematic diagram illustrating an exemplary embodiment of an alarm system in accordance with the present disclosure.

A method for self-testing notification appliances in accordance with the present disclosure will now be described more fully hereinafter with reference to the accompanying drawings, in which preferred embodiments of the invention are shown. The disclosed methods, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

It will be appreciated by those of ordinary skill in the art that the method described herein may be implemented in virtually any type of alarm or monitoring system, including, but not limited to, fire alarm systems, burglar alarm systems, surveillance systems, air quality monitoring systems, inventory monitoring systems, etc., or any combination thereof, such as may be provided for detecting an alarm event (e.g. a security breach) or a warning condition (e.g. an elevated temperature) in a building, structure, enclosure, or area. Many other applications are contemplated and may be implemented without departing from the scope of the present disclosure. All such applications are collectively referred to herein as "alarm systems."

Referring to FIG. 1, an exemplary alarm system 10 in accordance with the present disclosure is shown. The alarm system 10 may include a plurality of notification appliances 12 that may be installed throughout a monitored structure and connected to one or more alarm panels 14. Each notification appliance 12 may be associated with a unique address within the alarm system 10 for facilitating identification thereof by the alarm panel 14 and enabling selective routing of command/control signals from the alarm panel 14 to each notification appliance 12. The notification appliances 12 may be configured to provide notification of an alarm condition (e.g. fire and/or smoke) within the structure, such as may be detected by one or more initiating devices (not shown) in the alarm system 10. The notification appliances 12 shown in FIG. 1 are strobe/horn units, but it is contemplated that other varieties of notification appliances, such as sirens, bells, buzzers, etc., may additionally or alternatively be implemented in the alarm system 10 in a similar manner. For the sake of convenience and clarity, only three notification appliances 12 are shown, but it is to be understood that the alarm system 10 may include many additional notification appliances 12 without departing from the scope of the present disclosure.

The exemplary alarm system 10 may also include a workstation 16, such as a personal computer (PC) or server, which is operatively connected to the alarm panel 14. The workstation 16 may be loaded with one or more software applications that provide human operators of the system 10 with a user interface 18 for monitoring and controlling certain aspects of the alarm system 10. For example, the user interface 18 may allow an operator to observe the functional status of the notification appliances 12, and to activate, deactivate, test, inspect, or otherwise exert control over the notification appliances 12 as further described below. Alternatively, it is contemplated that the workstation 16 and user interface 18 may be entirely omitted from the alarm system 10, and that an operator may activate, deactivate, test, inspect, observe the functional status of, or otherwise exert control over the notification appliances 12 via the alarm panel 14.

Each of the notification appliances 12 may be equipped with one or more sensors 20 that are configured to measure the output of the notification features 26 (e.g. strobe and horn) of a respective notification appliance 12 as further described below. The sensors 20 may include any type of sensing or detecting devices or elements that are capable of measuring light and/or sound, including, but not limited to, microphones, sound detectors, cameras, photo eyes, light detectors, and the like. The sensors 20 may be mounted on the exteriors of the notification appliances 12, and/or may be disposed within the notification appliances 12.

It is contemplated that one or more of the notification appliances 12 may be configured for local, manual activation of an initial output function (described below). Such notification appliances 12 may be provided with a manually actuated input device 22, such as a switch or a button. The input devices 22 may be configured such that actuation of an input device 22 may cause a respective notification appliance 12 to activate its notification features 26 and measure the output of such features as further described below. Alternatively, if a notification appliance 12 is configured for remote activation of the initial output function, such as may be initiated at the alarm panel 14 or at the workstation 16, the input device 22 may be omitted.

The input devices 22 shown in FIG. 1 may be magnetic switches that are actuated by waving a magnetic key 24 (shown in FIG. 6) in close proximity thereto. Such magnetic keys 24 may be made available to a designated system inspector or group of designated system inspectors. Limiting access to the input devices 22 in this manner is advantageous because it prevents unauthorized individuals from interfering with the initial output function of the alarm system 10. However, it is contemplated that various other types of input devices 22 may additionally or alternatively be implemented without departing from the present disclosure. For example, it is contemplated that the input devices 22 may be simple buttons or switches that can be actuated by any individual.

Figure 2:
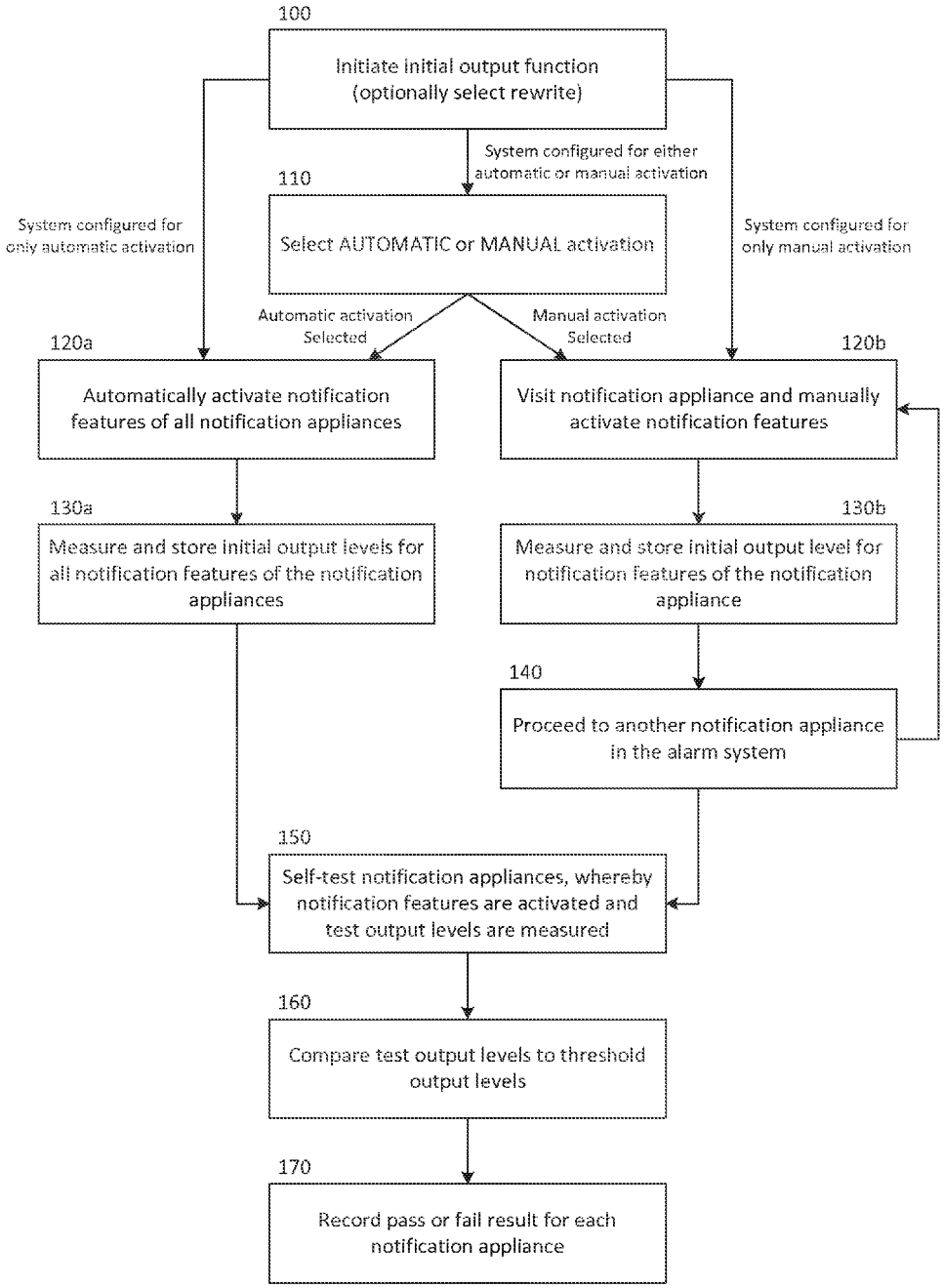
FIG. 2 is a flow diagram illustrating an exemplary embodiment of a method in accordance with the present disclosure.

Referring to FIG. 2, a flow diagram illustrating an exemplary method for self-testing and measuring performance degradation of the notification appliances 12 of the alarm system 10 in accordance with the present disclosure is shown. The method will now be described in detail in conjunction with the schematic representations of the alarm system 10 shown in FIGS. 3-7.

Figure 3:
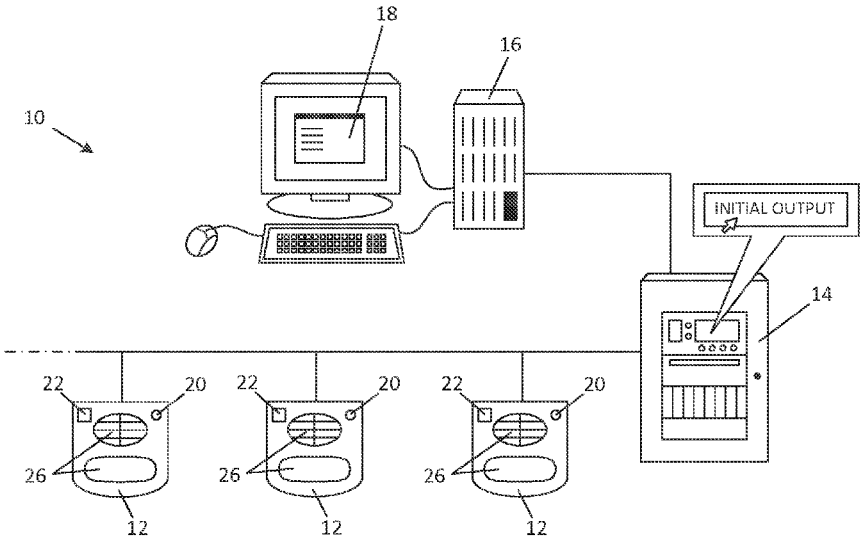
FIGS. 3-7 are a series of schematic diagrams illustrating the exemplary method shown in FIG. 2 being performed on the alarm system shown in FIG. 1.

At a first step 100 of the exemplary method, a commissioning technician or other designated party (hereinafter collectively referred to as "the technician") may initiate an "initial output" function of the alarm system 10 for measuring and recording the output of the notification features 26 of the notification appliances 12 in the alarm system 10. This may be achieved by making an appropriate selection in the user interface 18 or at the alarm panel 14 using appropriately configured soft or hard input means, such as by selecting a "INITIAL OUTPUT" or similarly labeled option in a menu or sub-menu of the alarm panel 14 as shown in FIG. 3. The initial output function may be performed as a final step of a commissioning test of a newly installed alarm system, but may also be performed at other times, such as upon the installation of new notification appliances within an existing alarm system as further described below.

Figure 4:
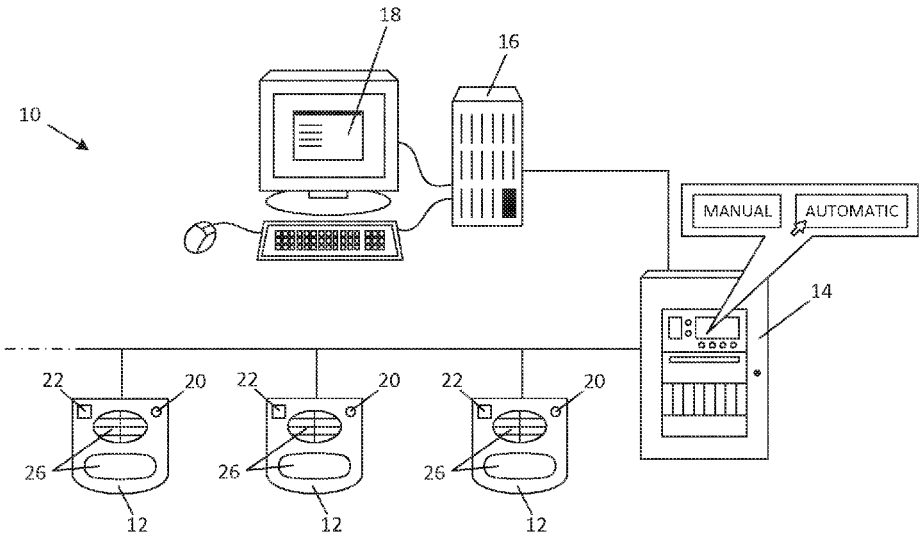

At step 110 of the exemplary method, the technician may be provided with an option to perform either "automatic activation" of the notification appliances 12, whereby the notification appliances 12 are automatically activated to effectuate the initial output function (as described below), or "manual activation" of the notification appliances 12, whereby the technician must physically visit and manually activate each notification appliance 12 to effectuate the initial output function (as described below). The technician may initiate either mode of activation by making an appropriate selection in the user interface 18 or at the alarm panel 14 using appropriately configured soft or hard input means, such as by selecting an "AUTOMATIC" or "MANUAL" option in a menu or sub-menu of the alarm panel 14 as shown in FIG. 4. Alternatively, if the alarm system 10 is configured only for "automatic activation" or only for "manual activation," the technician may not be provided with any such option.

Figure 5:
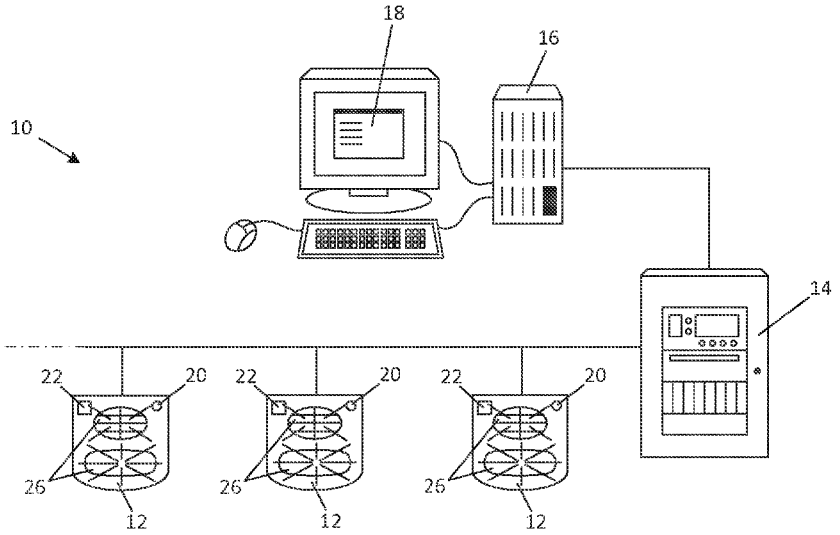

At step 120*a* of the exemplary method, if the technician selected automatic activation in step 110, or if the alarm system 10 is configured only for automatic activation, the notification features 26 of the notification appliances 12 may be activated for a predefined amount of time (hereinafter referred to as "the activation period") as shown in FIG. 5. It is contemplated that such activation of the notification appliances 12 may be performed simultaneously, whereby the notification features 26 of all notification appliances 12 in the alarm system 10 are activated at the same time, or sequentially, whereby the notification features 26 of one notification appliance 12 may be activated for the activation period and then deactivated, followed by the notification features 26 of a second notification appliance 12 being activated for the activation period and then deactivated, and so on. Sequential activation is more time consuming than simultaneous activation, but may be beneficial for preventing the active notification features 26 of one appliance from interfering with the initial output function of a nearby appliance, as will become apparent below.

The activation period may be of any duration that is suitable for allowing the sensor 20 of an activated notification appliance 12 to accurately measure the output of that appliance's notification features 26. For example, it is contemplated that the activation period may be between about 1 and 5 seconds. It is further contemplated that the activation period may be of such short duration as to render the activation visually and/or audibly imperceptible to human beings (e.g. less than 0.1 second). Limiting the duration of the activation period thusly may be beneficial for minimizing disturbances to occupants of a building during execution of the initial output function, as well as for significantly shortening the total duration of initial output function.

During the activation period, the sensor 20 of an activated notification appliance 12 may, at step 130*a* of the exemplary method, measure the output produced by that appliance's notification features 26. For example, the sensor 20 may measure the intensity of light emitted by the notification appliance's strobe or the volume of sound emitted by the notification appliance's horn. Such measured output values are hereinafter collectively referred to as "initial output levels." The initial output levels may be stored in an onboard memory of the notification appliance 12 and/or may be transmitted to the alarm panel 14 or workstation 16 and stored in a memory therein in association with the notification appliance's unique address. Such measurement and storage of initial output levels may be performed for each notification appliance 12 in the alarm system 10, after which the initial output function of the alarm system 10 may be concluded. The stored initial output levels may be used as benchmarks for subsequent self-testing of the notification appliances 12 as further described below.

Figure 6:
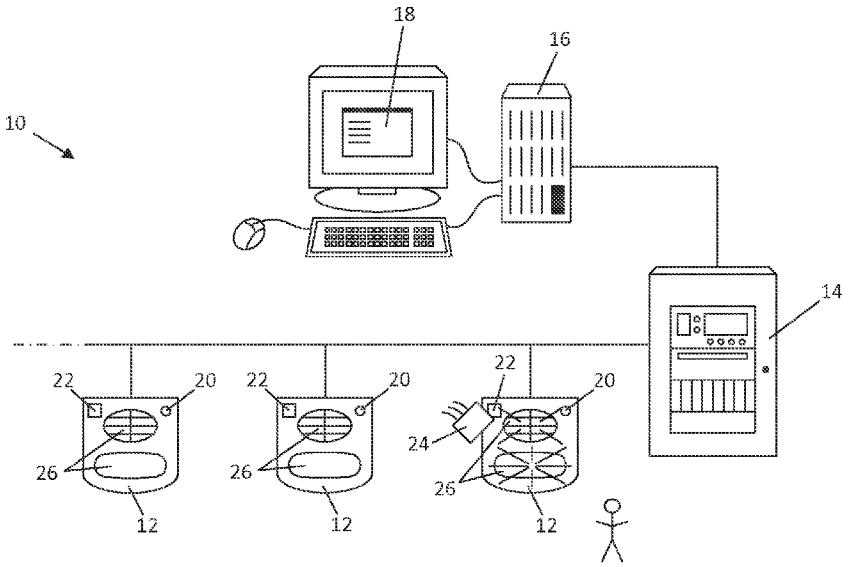

At step 120*b* of the exemplary method, if the technician selected manual activation in step 110, or if the alarm system 10 is configured only for manual activation, the technician may visit a first of the notification appliances 12 (e.g. the rightmost notification appliance 12 in FIG. 6) and may actuate the appliance's input device 22. For example, the technician may wave a magnetic key 30 in close proximity to the input device 22 as shown in FIG. 6. Actuating the input device 22 thusly may cause the notification features 26 of the notification appliance 12 to be activated for the activation period (described above).

During the activation period, the sensor 20 of the activated notification appliance 12 may, at step 130*b* of the exemplary method, measure the output produced by that appliance's notification features 26 and may store the measured output levels as described in step 130*a* above. Particularly, the sensor 20 may measure the intensity of light emitted by the notification appliance's strobe and/or the volume of sound emitted by the notification appliance's horn, and the measured initial output levels may be stored in an onboard memory of the notification appliance 12 and/or may be transmitted to the alarm panel 14 or workstation 16 and stored in a memory therein in association with the notification appliance's unique address.

Figure 7:
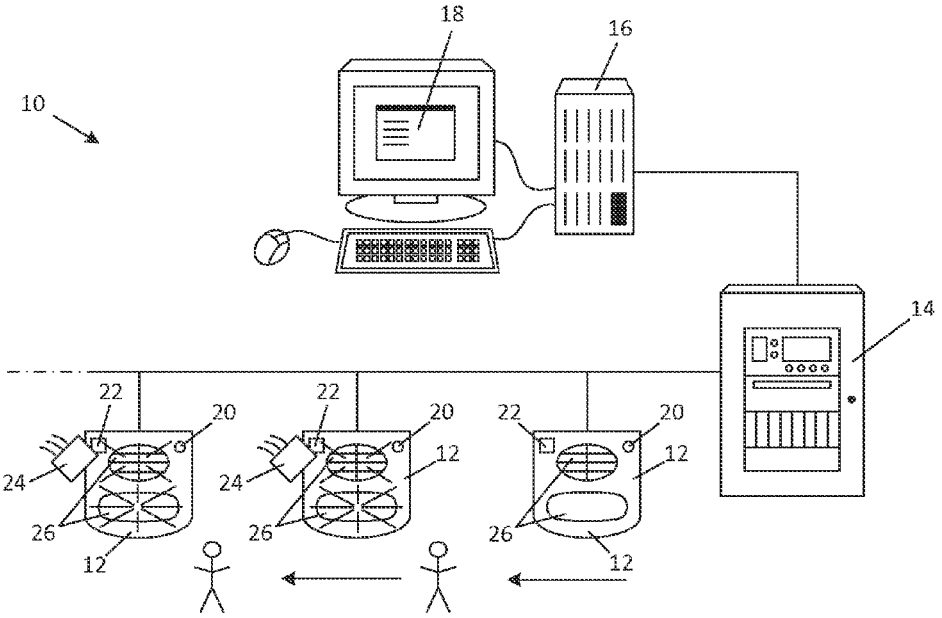

At step 140 of the exemplary method, the technician may proceed to the other notification appliances 12 in the alarm system 10 and may sequentially activate the notification features 26 of each notification appliance 12 in the manner described in step 120*b* above, as shown in FIG. 7. The initial output levels of the notification features 26 of all of the notification appliances 12 in the alarm system 10 may thereby be measured and stored in memory as described in step 130*b*, after which the initial output function of the alarm system may be concluded. The stored initial output levels may be used as benchmarks for subsequent self-testing of the notification appliances 12 as further described below.

At step 150 of the exemplary method, a self-test of the alarm system 10 may be performed at any time after conclusion of the initial output function performed in steps 100-140. Such self-testing may be effectuated by simultaneously or sequentially activating the notification features 26 of the notification appliances 12 for a predefined amount of time, during which the sensors 20 of the notification appliances 12 may measure the output produced by the activated notification features 26 in substantially the same manner as described in steps 130*a* and 130*b* above. Such measured output values are hereinafter collectively referred to as "test output levels."

At step 160 of the exemplary method, the measured test output levels of the notification features 26 may be compared against calculated "threshold output levels" that are derived from the respective initial output levels of the notification features 26 collected in steps 130*a* or 130*b* above. The threshold output levels represent acceptable levels of degradation of the notification features' performance, such as may occur over time (e.g. dimming of a strobe, attenuation of a horn, etc.). For example, it is contemplated that the threshold output levels may be calculated as percentages of the notification features' initial output levels, or by subtracting fixed values (e.g. a fixed number of candela or decibels) from the notification features' initial output levels. Various other methods for deriving the threshold output levels are contemplated and may be implemented without departing from the present disclosure. The calculation of the threshold output levels, as well as the comparison of the test output levels to the threshold output levels, may be performed by appropriately configured processors residing onboard each of the respective notification appliances 12. Alternatively, the calculations and comparisons may be performed by the alarm panel 14 or workstation 16.

At step 170 of the exemplary method, the alarm panel 14 or workstation 16 may record a "pass" result for each notification appliance 12 whose notification features 26 produced test output levels that exceeded respective threshold output levels as determined by the comparison performed in step 160. Conversely, the alarm panel 14 or workstation 16 may record a "fail" result for each notification appliance 12 whose notification features 26 produced test output levels that fell below respective threshold output levels. By recording such results for each of the notification appliances 12 in the alarm system 10 thusly, a complete functional test record for the entire alarm system 10 may be generated and made available for subsequent review by interested parties.

If additional notification appliances 12 are added to the alarm system 10 at any time, initial output levels may be measured and recorded for the newly added appliances by performing the initial output function of the alarm system 10 in substantially the same manner as described in steps 100-140. One difference, however, is that upon initiating the initial output function in step 100, a technician may be provided with an "overwrite" or similarly labeled option (see optional portion of step 100 in FIG. 2), such as may be presented to a technician by the user interface 18 or the alarm panel 14. If the technician selects such an overwrite option, the initial output function of steps 100-140 of the exemplary method may be performed for all of the notification appliances 12 in the alarm system 10, including new and old appliances. Initial output levels are thereby measured and recorded for all of the notification appliances 12, including overwriting the previously measured and recorded initial output levels of the old notification appliances 12 with newly measured and recorded initial output levels. Alternatively, if the technician does not select the overwrite option, the initial output function of steps 100-140 of the exemplary method may be performed for only the newly installed notification appliances 12, and the previously measured and recorded initial output levels of the old notification appliances 12 may be preserved. By requiring a technician to positively select or decline the rewrite option in the manner described above, accidental overwrite of existing initial output levels may be avoided.

The method described herein facilitates convenient determination of whether, and to what degree, the performance of a notification appliance in an alarm system has degraded over time. Interested parties may thereby ascertain whether a notification appliance is capable of emitting output at an acceptable level. This provides a significant advantage over existing self-test systems and methods which only provide a binary indication of whether a notification appliance is able to produce output or not.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The various embodiments or components described above may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system.

As used herein, the term "computer" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definition and/or meaning of the term "computer."

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. A method for self-testing notification appliances in an alarm system, the method comprising:

measuring and recording an initial output level of a notification feature of a notification appliance at a first time;

measuring a test output level of the notification feature at a second time after the first time;

comparing the test output level to a threshold output level that is derived from the initial output level;

recording a pass result for the notification appliance if the test output level exceeds the threshold output level; and recording a fail result for the notification appliance if the test output level does not exceed the threshold output level.

2. The method of claim 1, further comprising initiating an initial output function of the alarm system before measuring and recording the initial output level.

3. The method of claim 2, wherein initiating the initial output function comprises selecting a corresponding initial output option.

4. The method of claim 1, wherein the threshold output level is calculated as a percentage of the initial output level.

5. The method of claim 1, wherein the threshold output level is calculated by subtracting a fixed value from the initial output level.

6. The method of claim 1, wherein the step of measuring and recording the initial output level is initiated at a central alarm panel remote from the notification appliance.

7. The method of claim 1, wherein the step of measuring and recording the initial output level is initiated by actuating an input device on the notification appliance.

8. The method of claim 7, wherein actuating the input device comprises disposing a magnet in close proximity to a magnetic switch in the notification appliance.

9. The method of claim 1, wherein the step of measuring and recording the initial output level includes activating the notification feature for less than 0.1 seconds.

10. The method of claim 1, wherein the step of measuring and recording the initial output level includes storing the initial output level in a memory of the notification appliance.

11. A method for determining whether the performance of notification appliances in an alarm system has degraded over time, the method comprising:

measuring and recording initial output levels of notification features of the notification appliances at a first time; and adding a new notification appliance to the alarm system and repeating the step of measuring and recording the initial output levels of notification features for only the new notification appliance, whereby previously measured and recorded initial output levels for other notification appliances in the alarm system are preserved.

12. The method of claim 11, further comprising:

measuring test output levels of the notification features at a second time after the first time;

comparing the test output levels to respective threshold output levels that are derived from the initial output levels;

recording a pass result for notification appliances whose notification features produced test output levels that exceeded the respective threshold output levels; and recording a fail result for notification appliances whose notification features produced test output levels that did not exceed the respective threshold output levels.

13. The method of claim 12, wherein the threshold output levels are calculated as percentages of the initial output levels.

14. The method of claim 12, wherein the threshold output levels are calculated by subtracting fixed values from the initial output levels.

15. The method of claim 11, wherein the step of measuring and recording the initial output levels is initiated at a central alarm panel remote from the notification appliances.

16. The method of claim 11, wherein the step of measuring and recording the initial output levels is initiated by actuating input devices on each of the notification appliances.

17. The method of claim 11, wherein the step of measuring and recording the initial output levels includes activating the notification features for less than 0.1 seconds.

18. The method of claim 11, wherein the step of measuring and recording the initial output levels includes storing the initial output levels in memories of respective notification appliances.

19. The method of claim 11, further comprising adding a new notification appliance to the alarm system and repeating the step of measuring and recording the initial output levels of notification features, whereby previously measured and recorded initial output levels are replaced by newly measured and recorded initial output levels.

* * * * *